US006067900A

United States Patent [19]

Lackner et al.

[11] Patent Number: 6,067,900

[45] Date of Patent: May 30, 2000

[54] TRASH COMPACTOR WITH LIQUID DISPOSAL

[75] Inventors: Raymond F. Lackner, Pittsburgh; Daniel S. Glosser, Johnstown; Robert P. Zewe, West Mifflin, all of Pa.

[73] Assignee: Glosser Manufacturing Co., Inc., Johnstown, Pa.

[21] Appl. No.: 09/170,616

[22] Filed: Oct. 13, 1998

[51] Int. Cl.[7] ..... B30B 9/06

[52] U.S. Cl. ..... 100/111; 100/126; 100/134; 100/229 A

[58] Field of Search ..... 100/110, 111, 100/125–127, 131, 134, 229 A; 220/908

[56] References Cited

U.S. PATENT DOCUMENTS

| | | | |
|---|---|---|---|
| 902,115 | 10/1908 | Sharp | 100/127 |
| 3,133,492 | 5/1964 | Czulak et al. | 100/110 |
| 3,212,656 | 10/1965 | Kamin | 100/126 |
| 3,229,622 | 1/1966 | French et al. | 100/229 A |
| 3,880,072 | 4/1975 | Ord | 100/229 A |
| 5,193,453 | 3/1993 | Lundy . | |
| 5,234,309 | 8/1993 | Foster . | |

*Primary Examiner*—Stephen F. Gerrity
*Attorney, Agent, or Firm*—George Raynovich, Jr.

[57] ABSTRACT

A trash compactor having a compactor unit and a separable trash storage container is provided that accommodates liquid within the trash that is compacted. The liquid is admitted into a reservoir within the storage container of the trash compactor where it is isolated from the compacted trash. When the storage container is removed to a disposal site, the compacted trash is emptied and the liquid from the reservoir is also emptied at the disposal site. For trash that has a large volumetric quantity of liquid, an overflow tank may be provided in the storage container to receive the overflow from the reservoir within the storage container. The overflow tank may also receive liquid that accumulates in the compactor unit while the compactor is operating.

18 Claims, 5 Drawing Sheets

TRASH COMPACTOR WITH LIQUID DISPOSAL

BACKGROUND OF THE INVENTION

1. Field of the Invention.

This invention relates to trash compactors and more particularly, to a trash compactor that accommodates liquid that may be included with the trash to prevent the liquid from spilling out of the trash compactor and contaminating the surrounding area.

2. Description of the Prior Art.

Collecting and transporting trash from urban areas has become a major industry throughout the civilized world. Because trash must be transported from urban areas to areas where it can be left in landfills or otherwise disposed of, an important function in transporting trash is to first compact it so as to reduce the volume required to transport a given weight of waste material.

Trash compactors have been utilized in shopping centers and shopping malls so that the tenants of such retail establishments can compact trash and have it hauled away with efficiency. Unfortunately, trash that is compacted in such compactors often has liquid that escapes the compactor and contaminates the area around the trash compactor creating unsanitary conditions. To date, no successful way has been found to provide a trash compactor that accommodates the liquid within the trash, keeps it from spilling in the area of the trash compactor, and provides for the disposal of the liquid at the landfill or other site where the compacted trash is dumped.

The present invention provides a trash compactor that overcomes the disadvantages of earlier trash compactors so that any liquid in the trash that is compacted is received within a reservoir built into the portion of the trash compactor that is hauled to the disposal site. When at the disposal site, the reservoir may be emptied of the liquid that has been retained in it.

SUMMARY OF THE INVENTION

In accordance with the present invention, there is provided a trash compactor with a separable trash storage container that includes a compactor unit having a reciprocable ram for forcing trash into the separable storage container where the trash is compacted. The separable box-like storage container is removably connected to the compactor unit so that the storage container can be transported and emptied at a remote location without disturbing the compactor. The storage container includes an opening in one wall through which the reciprocable ram forces trash into the storage container. A liquid reservoir within the storage container collects liquid separated from the trash as the trash is introduced into the storage container. The liquid is directed from the storage container into the liquid reservoir where the liquid is retained and not spilled when the storage container is removed from the trash compactor and transported to a remote location to be emptied. The reservoir can be emptied at the remote location where the compacted trash is dumped.

Further in accordance with the present invention, the trash compactor as described above may also have an overflow tank to receive overflow from the reservoir or to receive liquid that collects in the compactor unit itself. The overflow tank is positioned within the box-like storage container. A gravity filled holding tank is positioned within the reservoir to receive liquid from the reservoir when the liquid level in the reservoir rises above the level of the entry port to the gravity filled holding tank. A pump positioned within the compactor unit operates to pump liquid from the holding tank to the overflow tank. Piping connects the pump, the holding tank and the overflow tank.

Accordingly, an object of the present invention is to provide a trash compactor that accommodates the sanitary disposal of liquid that may be mixed with the trash.

Another object of the present invention is to provide a trash compactor that may accommodate large amounts of liquid.

These and other objects of the present invention will become apparent as this description proceeds in connection with the following specification, accompanying drawings and the appended claims.

DESCRIPTION OF THE PREFERRED EMBODIMENTS

Figure 1:
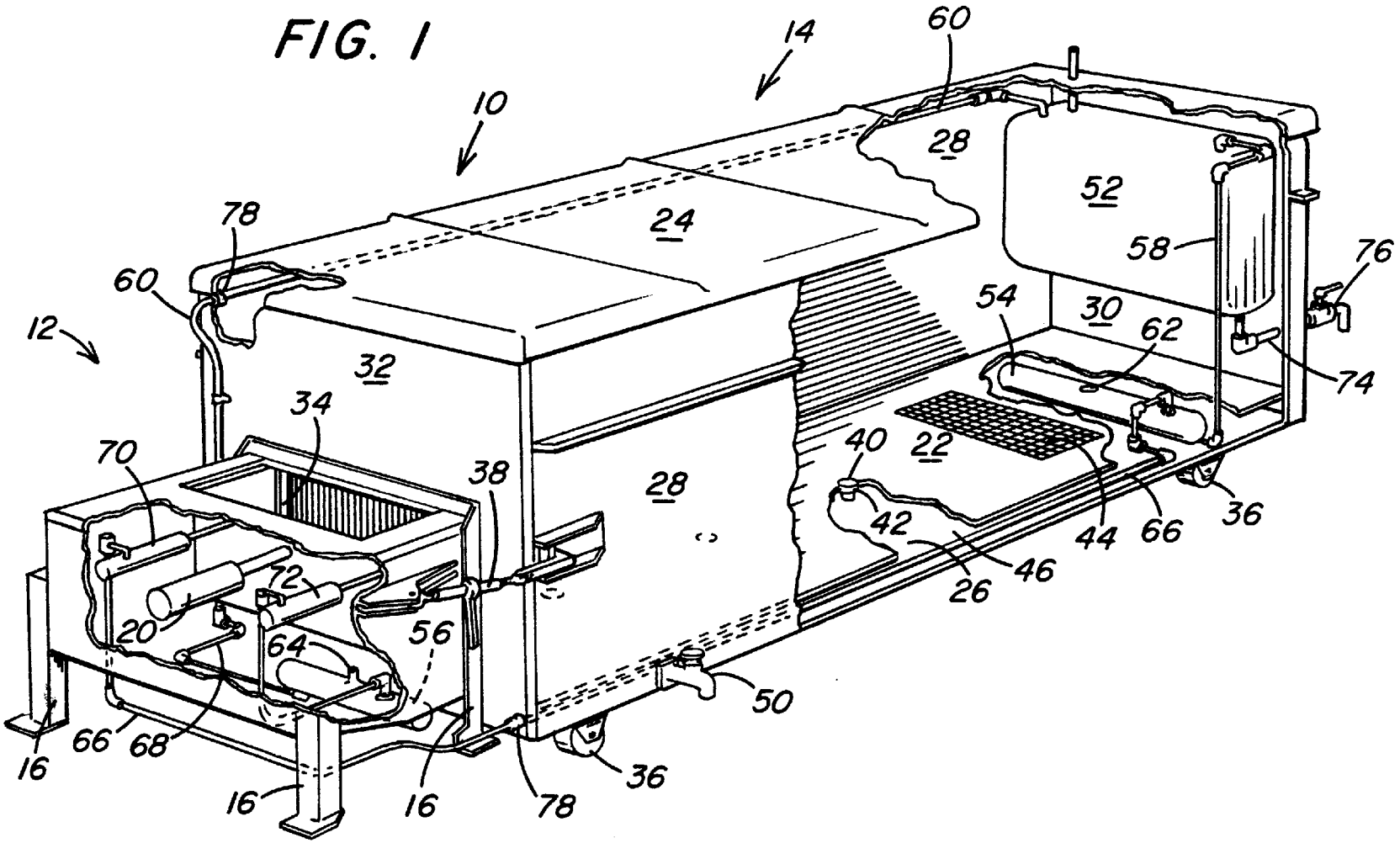
FIG. 1 is a cut-away perspective view of the trash compactor of the present invention.

Referring to the drawings, there is shown a trash compactor 10 having a compactor unit shown generally at 12 and a box-like storage container shown generally at 14. The compactor unit 12 has legs 16 which are fastened to the floor where the compactor unit is located so that the compactor unit 12 is fixed in place and stationary.

The compactor unit 12 has a reciprocable ram 18 operated by a hydraulic cylinder and piston 20. The compactor unit 12 is generally a standard unit except that it has been raised from the floor to accommodate trash entering the box-like storage container at a higher level so that a liquid reservoir may be positioned within the box-like storage container as will be described.

The box-like storage container 14 has a floor 22, a top wall 24, a bottom wall 26, side walls 28, and an end wall 30 at the far end from the trash compactor unit 12. The end wall 32 adjacent the compactor unit 12 has an opening 34 to accommodate entry of the ram 18 into the storage container 14. The opening 34 may be closed by a door (not shown) when the storage container 14 is removed for disposal of the compacted trash. The storage container 14 has wheels 36 to facilitate movement of the storage container 14 toward and away from the compactor unit 12.

Mechanical connectors 38 are positioned on each side of the compactor unit 12 to connect and hold tight the storage container 14 to the compactor unit 12 while trash is being compacted by the compactor unit 12 within the storage container 14.

The floor 22 of the storage container 14 contains several passages 40 that have one-way check valves 42 positioned in them. The passages 40 and the check valves 42 permit liquid to drain from the interior of the storage container 14 into a liquid-tight reservoir 46 that is formed by the floor 22 of the storage container 14 with the bottom wall of the storage container 14 and portions of the side walls 28 and end walls 30 and 32 of the storage container. A grate 44 is also positioned in the floor 22 of storage container 14 to permit the unimpeded flow of liquid through grate 44.

An outlet pipe 48 communicates with the interior of reservoir 46 and has an outlet gate valve 50 positioned on it. The opening of outlet valve 50 permits liquid to be drained from reservoir 46.

Figure 3:
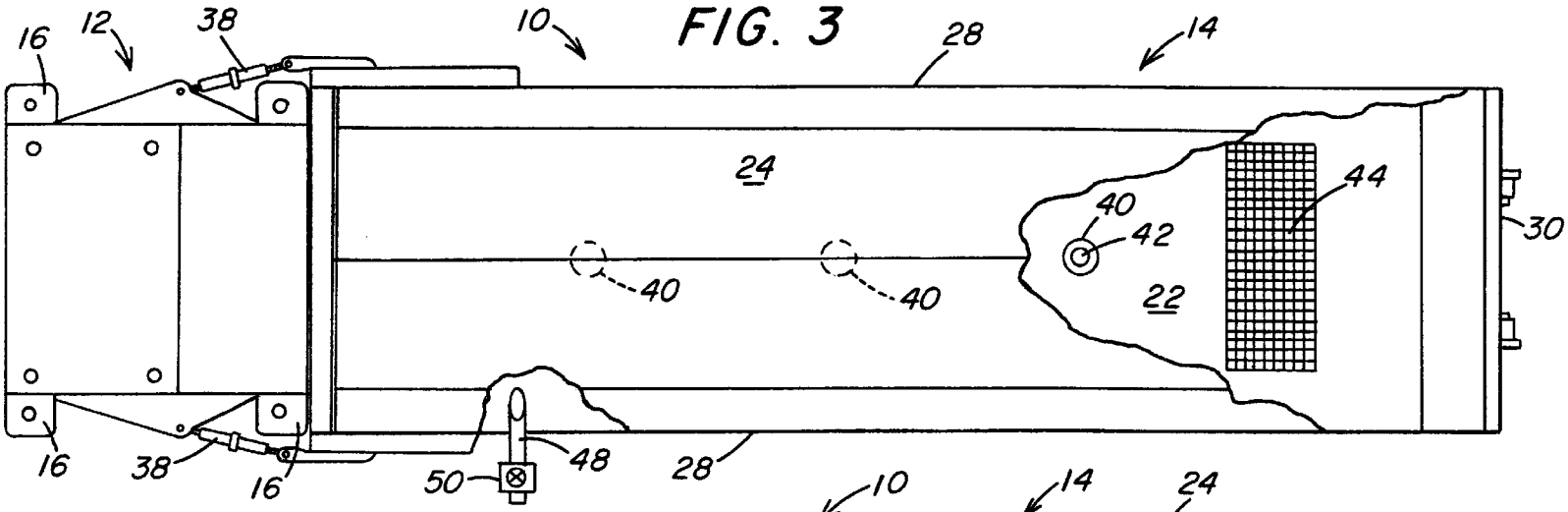
FIG. 3 is a top plan view in partial section of the trash compactor of FIG. 2.
Figure 2:
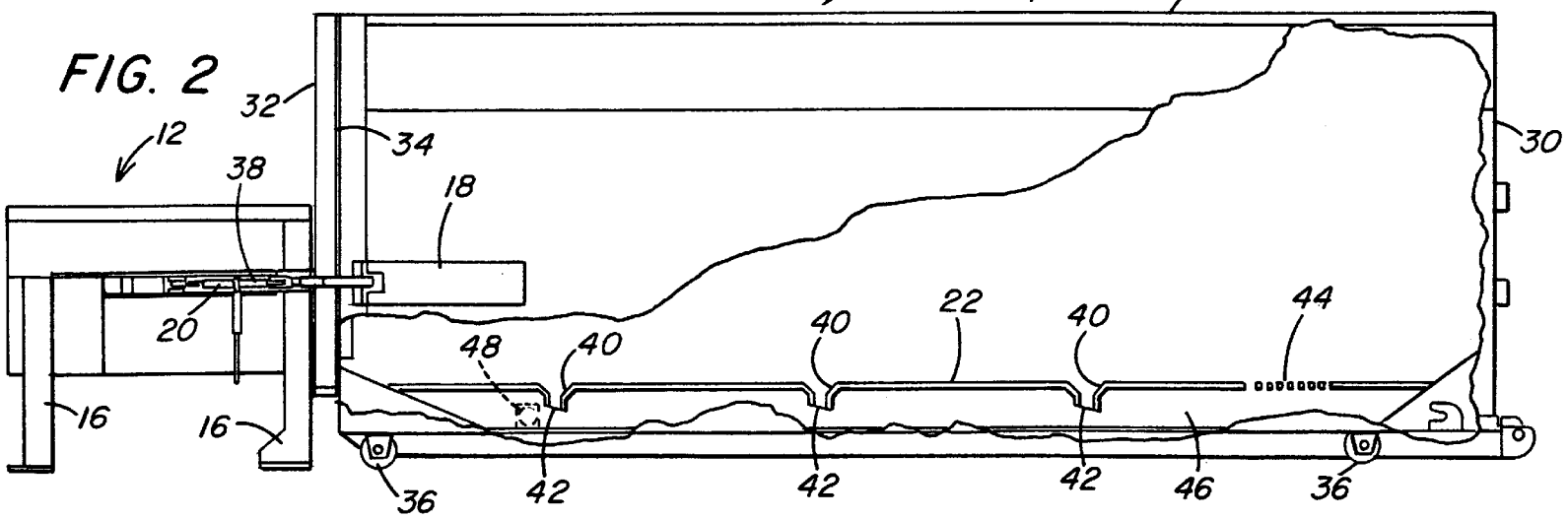
FIG. 2 is a side elevation in section of the trash compactor of the present invention.
Figure 6:
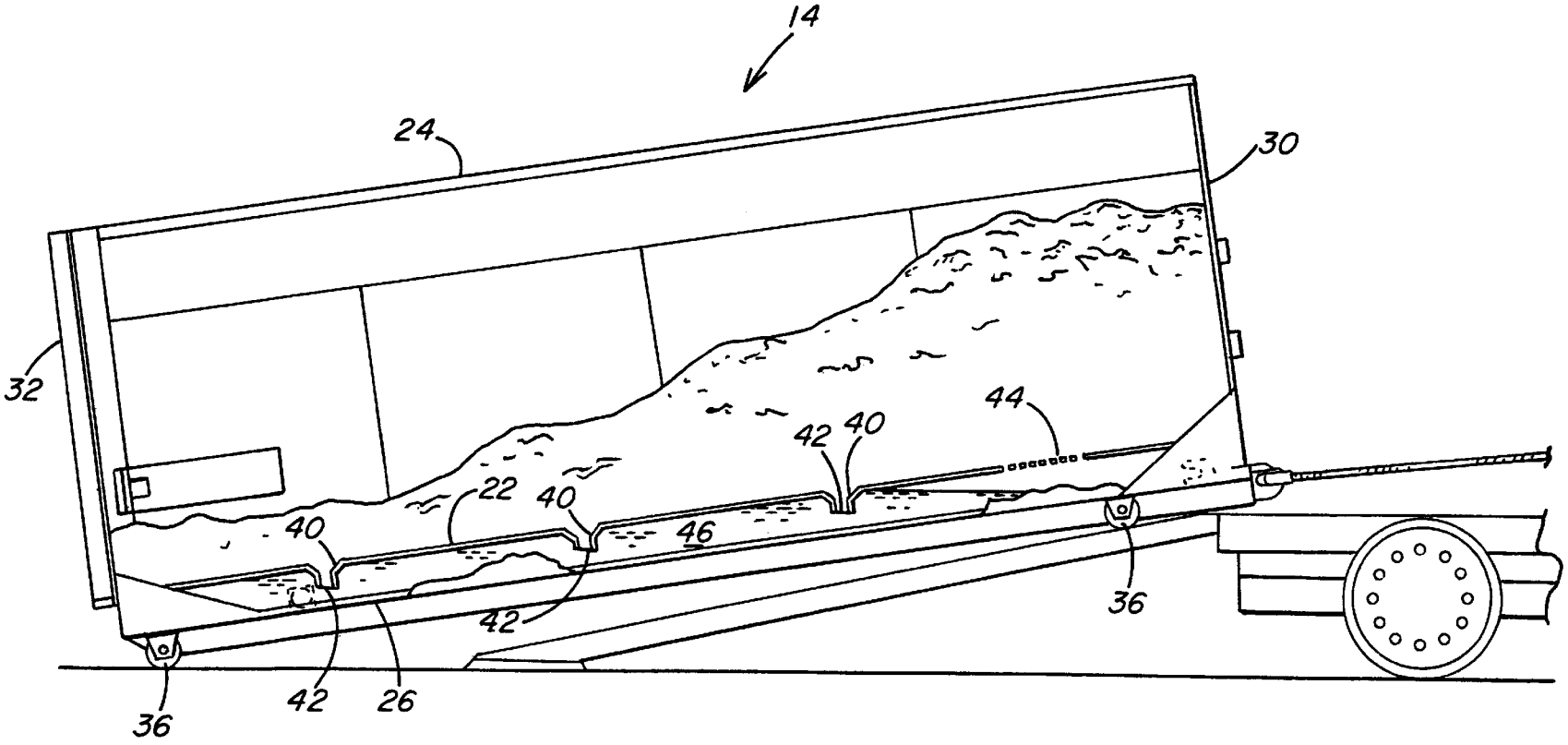
FIG. 6 is a side view of the box-like storage container being placed upon a truck for removal to a disposal site.

In the embodiment of the invention-shown in FIGS. 2 and 3 as has just been described, when trash is compacted by compactor unit 12 and forced into the box like storage container 14, any liquid that becomes liberated by the compacting process drains down to the floor 22 of the storage container 14 and enters into reservoir 46 through passages 40 and grate 44. That liquid remains isolated from the compacted trash and is not spilled since the reservoir 46 is liquid tight. When the storage container 14 is tipped upwardly to be placed upon a truck as shown in FIG. 6, the grate 44 is at the upper end of the reservoir 46 so that no liquid can run out through grate 44. The check valves 42 prevent liquid from running out of the reservoir 46. Thus, the liquid remains in the reservoir 46 until the storage container 14 reaches the disposal site. At the same time trash is being dumped from the storage container 14, outlet valve 50 can be opened to dispose of the liquid at the disposal site.

Figure 4:
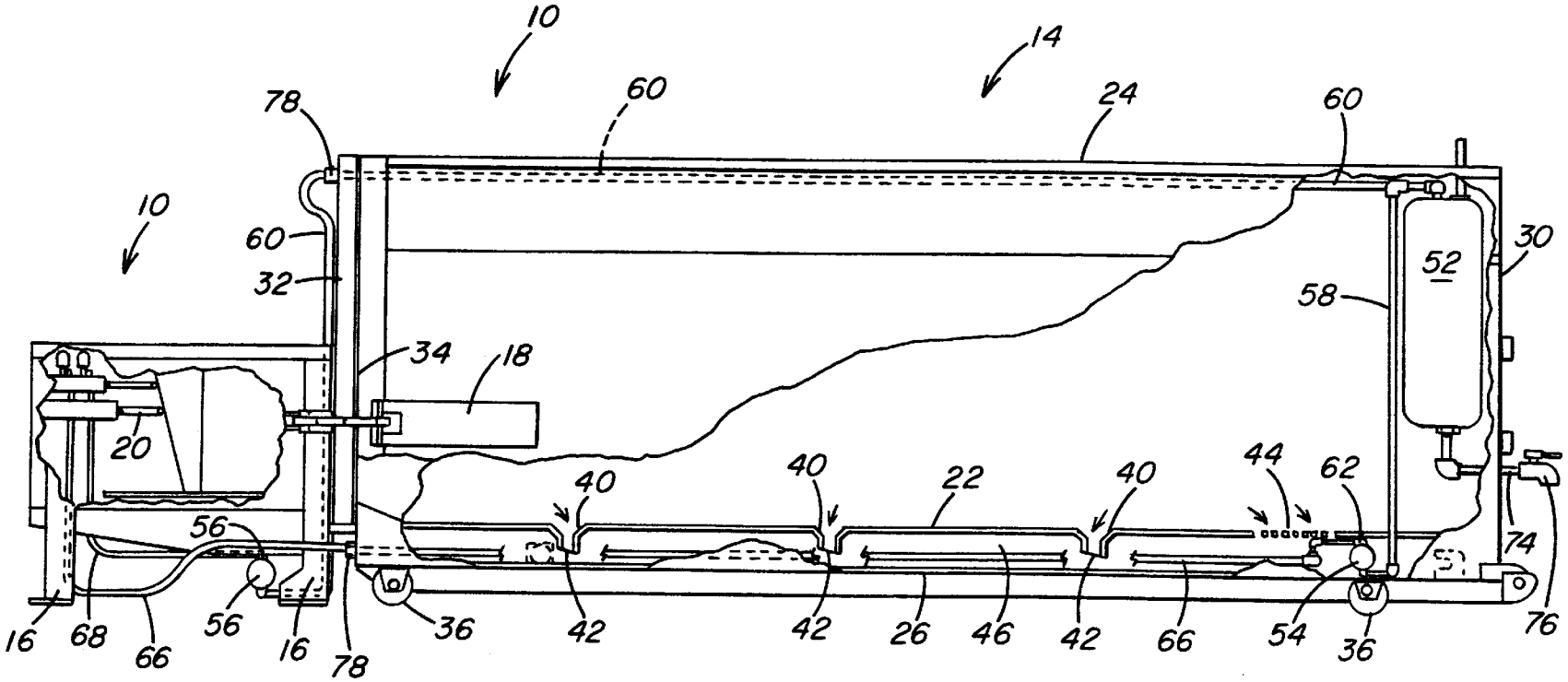
FIG. 4 is a side elevation in section of another embodiment of the present invention.
Figure 5:
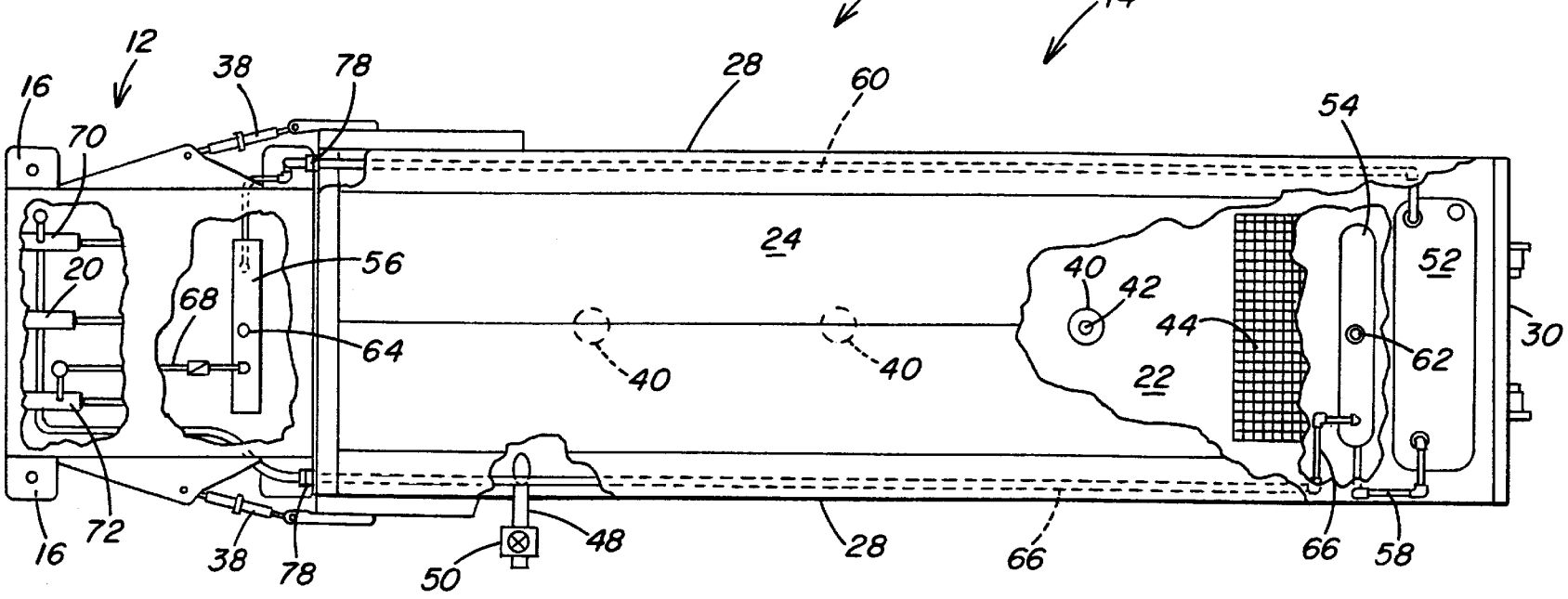
FIG. 5 is a top plan view in partial section of the trash compactor of FIG. 4.

If the liquid in the trash being compacted is particularly voluminous and cannot be accommodated totally by reservoir 46, an overflow tank 52 is provided as shown in FIGS. 4 and 5. In FIGS. 4 and 5, the components that have already been identified in connection with the embodiment shown in FIGS. 2 and 3 bear the same reference numerals as those components described in connection with FIGS. 2 and 3 and the description of those components will not be repeated here.

As shown in FIGS. 4 and 5, an overflow tank 52 is positioned within the box like storage container 14 adjacent to end wall 30. The overflow tank 52 receives overflow from the reservoir 46 and may also directly receive liquid that might accumulate in the compactor unit 12. A holding tank 54 is positioned within reservoir 46. A second holding tank 56 is positioned below the floor of compactor unit 12. A liquid pipe 58 conveys liquid from the holding tank 54 into overflow tank 52. A second liquid pipe 60 conveys liquid from second holding tank 56 into overflow tank 52. The holding tank 54 has a check valve 62 positioned in the top of the holding tank 54. When the liquid level in reservoir 46 reaches the level of the top of holding tank 54, liquid from the reservoir 46 enters into holding tank 54 through check valve 62. Likewise, liquid accumulated above the floor of compactor unit 12 enters into second holding tank 56 through a check valve 64 formed in second holding tank 56.

A compressed air pipe 66 conveys compressed air from a pump 70 into holding tank 54 so that the surface above the liquid within holding tank 54 is pressurized to thereby force the liquid out of holding tank 54 and into the overflow tank 52. Likewise, a second compressed air pipe 68 conveys compressed air from a second pump 72 into second holding tank 56 to force liquid out of second holding tank 56 and into the overflow tank 52 through second liquid pipe 60.

The pumps 70 and 72 are standard pumps that compress air with a reciprocating piston. The pumps are fixed to the reciprocable ram 18 so that as the ram operates, the pumps 70 and 72 compress air and force it through the compressed air pipes 66 and 68, respectively. It should be noted that while compressed air pumps operating off the reciprocable ram 18 are shown and described, the system contemplates utilizing any type of efficient pump such as an electrically operated pump to pump liquid directly or an electrically operated air compressor to provide compressed air to force liquid from holding tank 54 and second holding tank 56 into the overflow tank 52.

The overflow tank 52 has an outlet pipe 74 with an outlet valve 76 which normally remains closed. When the storage container 14 reaches the disposal site, the outlet valve 76 may be opened to empty the liquid from overflow tank 52. Pipe disconnects 78 are provided in liquid pipe 60 and compressed air pipe 66 so that the storage container 14 may be separated from the compactor unit 12. When a new storage container 14 is positioned on to the compactor unit 12, the pipe disconnects 78 from the appropriate pipes are connected so that the system may function.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A trash compactor with a separable trash storage container comprising:

a compactor unit having a reciprocable ram for forcing trash into said separable storage container where said trash is compacted;

a separable box-like trash storage container removably connected to said compactor unit so that said storage container can be transported and emptied at a remote location without disturbing said compactor, said storage container including an opening in one wall through which said reciprocable ram forces trash into said trash storage container;

a liquid reservoir within said storage container and positioned beneath the floor of said storage container to collect liquid separated from said trash introduced into said storage container;

means including a plurality of passages containing one-way check valves formed in the floor of said storage container to communicate with said reservoir to direct liquid from said storage container into said liquid reservoir whereby said liquid is retained in said reservoir and not spilled when said storage container is removed from said trash compactor and transported to a remote location to be emptied; and means to empty liquid from said reservoir at said remote location.

2. The trash compactor of claim 1 wherein said separable box-like storage container contains an overflow tank to contain liquid that cannot be retained in said reservoir together with means in said compactor unit and said storage container to move liquid from said reservoir into said overflow tank.

3. The trash compactor of claim 2 wherein said means in said compactor unit and said storage container to move liquid from said reservoir into said overflow tank includes a pump located in said compactor unit and a gravity-filled holding tank located in said reservoir with appropriate piping connecting said pump, said holding tank and said overflow tank.

4. The trash compactor of claim 3 wherein said gravity-filled holding tank has a one-way check valve to admit liquid into said holding tank.

5. The trash compactor of claim 3 wherein said pump is a compressed air pump that pumps compressed air into said holding tank to force liquid from said holding tank into said overflow tank.

6. The trash compactor of claim 5 wherein said pump is activated by the movement of said compactor unit reciprocable ram.

7. A trash compactor with a separable trash storage container comprising:

a compactor unit having a reciprocable ram for forcing trash into said separable storage container where said trash is compacted;

a separable box-like trash storage container removably connected to said compactor unit so that said storage container can be transported and emptied at a remote location without disturbing said compactor, said storage container including an opening in one wall through which said reciprocable ram forces trash into said trash storage container;

a liquid reservoir formed beneath the floor of said box-like trash storage container to collect liquid separated from said trash introduced into said storage container;

a plurality of passage formed in said storage container floor to introduce liquid from said storage container into said liquid reservoir;

a plurality of check valves positioned within said plurality of passages to admit liquid into said reservoir but to prevent liquid from leaving said reservoir whereby said liquid is retained in said reservoir and not spilled when said storage container is removed from said trash compactor and transported to a remote location to be emptied; and a manually operated valved passage communicating with said reservoir to empty said reservoir.

8. The trash compactor of claim 7 wherein said reservoir has a two-way grate opening adjacent to the end of said storage container whereby when said storage container is removed from said compactor unit liquid does not escape from said reservoir through said grate opening.

9. The trash compactor of claim 7 wherein said manually operated valved passage includes a pipe communicating with said reservoir and a gate valve to open and close said pipe.

10. A trash compactor with a separable trash storage container comprising:

a compactor unit having a reciprocable ram for forcing trash into said separable storage container where said trash is compacted;

a separable box-like trash storage container removably connected to said compactor unit so that said storage container can be transported and emptied at a remote location without disturbing said compactor, said storage container including an opening in one wall through which said reciprocable ram forces trash into said trash storage container;

a liquid reservoir formed beneath the floor of said box-like trash storage container to collect liquid separated from said trash introduced into said storage container;

a plurality of passages formed in said storage container floor to introduce liquid from said storage container into said liquid reservoir;

a plurality of check valves positioned within said plurality of passages to admit liquid into said reservoir but to prevent liquid from leaving said reservoir whereby said liquid is retained in said reservoir and not spilled when said storage container is removed from said trash compactor and transported to a remote location to be emptied;

a liquid overflow tank positioned within said box-like storage container to contain liquid that cannot be retained within said reservoir;

a gravity-filled holding tank positioned within said reservoir to receive liquid from said reservoir when the liquid level in said reservoir rises above the level of an entry port to said gravity filled holding tank; said entry port having a one-way check valve to admit liquid to said holding tank;

a pump positioned within said compactor unit and operable to pump liquid from said holding tank to said overflow tank;

piping connecting said pump, said holding tank and said overflow tank;

a manually operated valved passage communicating with said reservoir to empty said reservoir; and a manually operated valved passage communicating with said overflow tank to empty said overflow tank.

11. The trash compactor of claim 10 wherein said pump is a compressed air pump that forces compressed air into said holding tank to force liquid from said holding tank into said overflow tank.

12. The trash compactor of claim 10 wherein said pump is activated by the movement of said compactor unit reciprocable ram.

13. The trash compactor of claim 12 wherein a second gravity-filled holding tank is positioned in said compactor unit to receive liquid from said compactor that is thereafter transferred to said overflow tank in said box-like storage container.

14. The trash compactor of claim 13 wherein liquid is transferred from said second gravity-filled holding tank to said overflow tank by a second pump positioned in said compactor unit and piping connecting said second pump, said second gravity-filled holding tank and said overflow tank.

15. The trash compactor of claim 14 wherein said piping connecting said second pump, said second holding tank and said overflow tank has disconnect fittings to permit separation of said box-like trash storage container from said compactor unit so that said storage container can be removed to be emptied.

16. The trash compactor of claim 14 wherein said second pump is a compressed air pump that forces compressed air into said second holding tank to force liquid from said holding tank into said overflow tank.

17. The trash compactor of claim 14 wherein said second pump is activated by the movement of said compactor unit reciprocable ram.

18. The trash compactor of claim 10 wherein said piping connecting said pump, said holding tank and said overflow tank has disconnect fittings to permit separation of said compactor unit from said box-like trash storage container so that said trash storage container can be removed to be emptied.

* * * * *